United States Patent [19]

Olsen

[11] 4,385,690

[45] May 31, 1983

[54] PACKAGE UNIT CARRIER

[75] Inventor: Robert C. Olsen, Streamwood, Ill.

[73] Assignee: Illinois Tool Works Inc., Chicago, Ill.

[21] Appl. No.: 324,723

[22] Filed: Nov. 25, 1981

[51] Int. Cl.[3] ..... B65D 85/62; B65D 75/56; B65D 71/02

[52] U.S. Cl. ..... 206/150; 206/428

[58] Field of Search ..... 206/428, 162, 150; 229/29 B, 28 BC, 89, 52 AL

[56] References Cited

U.S. PATENT DOCUMENTS

| | | | |
|---|---|---|---|
| 3,930,578 | 1/1976 | Stein | 206/150 |
| 4,269,308 | 5/1981 | Platt | 206/150 |
| 4,269,314 | 5/1981 | Barrash | 206/428 |

*Primary Examiner*—William T. Dixson, Jr.
*Assistant Examiner*—Brenda J. Ehrhardt

[57] ABSTRACT

A plastic band is provided for encircling and combining into a single package two six-pack assembly of cans into a package of 12 cans, or similarly for assembling eight bottles. The plastic carrier or band of the present invention encircles the outside of the assembly of cans or bottles, and further provides a central stablizing band or strap.

8 Claims, 3 Drawing Figures

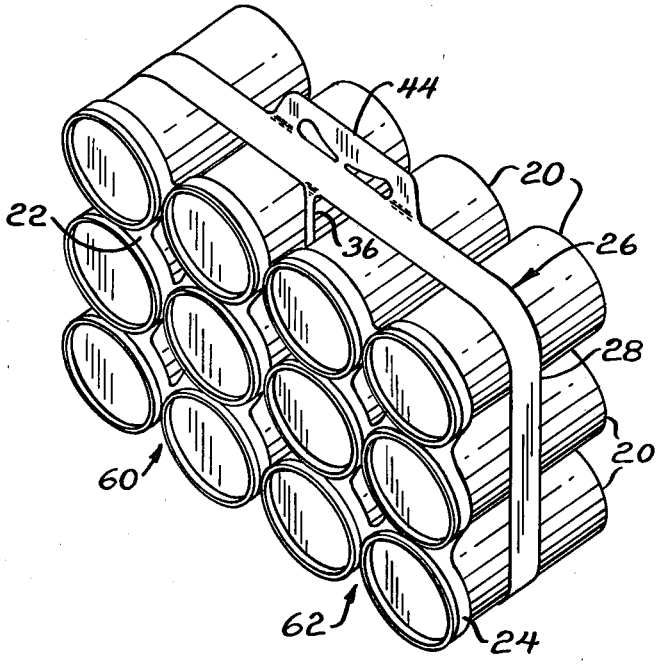
FIG. 1
FIG. 2
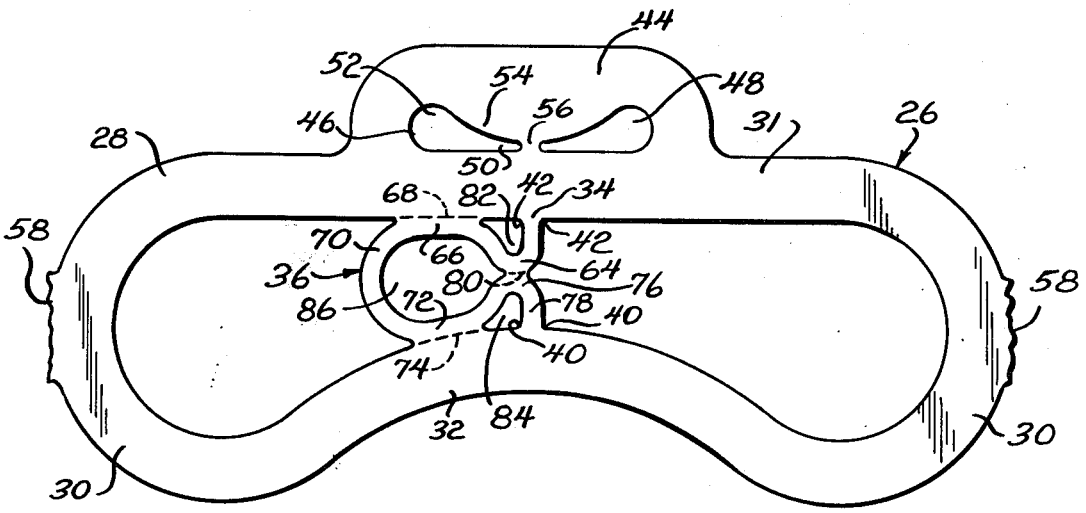
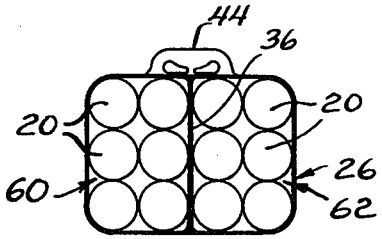
FIG. 3

PACKAGE UNIT CARRIER

RELATED APPLICATION

The present application is related to application Ser. No. 324,724, filed Nov. 25, 1981, both the present and related application being assigned to Illinois Tool Works Inc., Chicago, Illinois.

BACKGROUND OF THE INVENTION

Various types of carriers have been revealed in the patent arts and have been used commercially for assembling a predetermined number of containers, often six in number, for carrying of the containers. Typically, six cans may be carried together, and in a preferred form of package there is a sheet of plastic having six apertures therein respectively slightly less in diameter than the cans, so that the plastic material is stretched about the respective cans in generally inverted conical shape, thus securely underlying the can beads to prevent undesired withdrawal of the cans. As is known, a lateral movement of a can stretches the respective encircling band so that the can can be tipped from carrying position. Such carriers are shown, for example, in U.S. Pat. Nos. 2,874,835 and 3,874,502. Larger numbers of cans have been handled by similar carriers, see for example, U.S. Pat. No. 4,018,331 shows a carrier of the type in question for 12 cans.

Under some circumstances a package of 12 cans may be somewhat unstable or difficult to carry, and in U.S. Pat. No. 4,269,308 there is shown and described a plastic encircling band which circumscribes the 12 cans and holds them in close contiguous relation. The band is provided with a handle for carrying of the 12 pack.

OBJECTS AND SUMMARY OF THE PRESENT INVENTION

It is an object of the present invention to provide an encircling band carrier for a plurality of cylindrical containers which may be otherwise secured together, which carrier ensures stability of the resulting package of containers.

More specifically, it is an object of this invention to provide an integral band plastic carrier for a double six pack of cans, or a double four pack of bottles in which each of the subpackages is fully encircled.

In achieving the foregoing and other objects in accordance with the present invention, a plastic package unit is provided which completely encircles a group of cylindrical containers, such as a double six pack of cans, or a double four pack of bottles. A subsidiary dividing band is provided which lies between the subpacks, such as the two six packs of cans, whereby each subpack is retained in stable condition independently, while the total package is also retained in stable condition. The band or package unit is initially provided stamped from a sheet of plastic material in collapsed condition, with the outer portion thereof forming the overall encircling band, and with an inner portion providing a collapsed separating band. Successive package units are integrally joined together in an elongated strip, and are separated preferably after assembly with the cans or other containers.

IN THE DRAWINGS

The invention will best be understood from the following description when taken in connection with the accompanying drawings, wherein:

FIG. 1 is a perspective view of a package secured by a package unit carrier constructed in accordance with the present invention;

FIG. 2 is a view on an enlarged scale of the package unit carrier in blank form; and FIG. 3 is a somewhat stylized end view of the package of FIG. 1 on a reduced scale.

DETAILED DESCRIPTION OF THE ILLUSTRATED EMBODIMENT

With reference now in greater particularity to the drawings, there will be seen in FIGS. 1 and 3 a plurality of cylindrical containers, specifically cans 20 which are secured by plastic can carriers 22 and 24 which are of the type shown in U.S. Pat. No. 2,874,835, forming two six packs of cans, respectively identified at 60 and 62. The two six packs are secured together as a single package by a 12 pack band or package unit carrier 26 comprising a strip 28 encircling the cans.

The strip 28 is initially constructed as shown in FIG. 2 comprising a pair of arcuate end sections 30 integrally interconnected by a top (as shown in FIG. 1) straight strip section 31, and a lower reversely curved strip section or portion 32. On a vertical midline of the carrier there is integrally at 34 an intermediate strip 36 which is also integrally connected to the reversely curved portion 32. The connections are made at small diameter roots 40 (lower) and 42 (upper) to avoid stress concentrations that might cause tearing off of the intermediate strip 36. As will be seen in FIGS. 1 and 3 the intermediate strip 36 lies between the two six-can packages, whereby each can is directly contacted by a portion of the carrier 26 to retain the cans securely in the intended assembly of FIG. 1.

The carrier 26 is provided along the straight upper portion 31 with a handle 44 having a pair of apertures 46 and 48 arranged in mirror-image relationship therein. Each aperture includes at the end thereof remote from the midline of the carrier an enlarged section 52 which is largely circular in nature, and a reduced section 50 toward the midline. The upper edge of the aperture connecting the aforesaid two portions is downwardly convex, thus providing a small flap 54 which will roll up as the user's fingers are inserted through the apertures 46 and 48 for a more comfortable engagement of the fingers with the handle. A tab 56 lies intermediate the apertures 46 and 48, thereby providing enhanced strength for the handle 44.

It is heretofore noted the intermediate strip 36 initially is secured (FIG. 2) with a vertical upper portion 34 connected at 42 to the straight portion 31 of the strip 28. The strip continues down to an upwardly curved, nearly semi-circular portion 64, which then reversely curves into a horizontal section 66 joined to the straight upper portion 31 along a fracture line 68 which may be perforated, creased, or otherwise weakened for severability at that location during assembly. The horizontal portion 66 continues into a substantially semi-circular portion 70 which leads to a slightly inclined upwardly portion 72 connected to the reversely curved strip portion 32 along a severability line 74 which may be perforated, creased, or otherwise weakened for subsequent severance during assembly of the carrier with a double six pack of cans. The intermediate strip portion 72 continues into a generally semi-circular portion 76 which continues vertically down at 78 in alignment with the upper portion 34, being integrally connected to the reversely curved strip portion 32 at the roots 40. The two semi-circular portions 64 and 76 abut and are integrally joined to one another along a severable area 80 which again may be perforated, creased, or otherwise weakened.

The upper portion of the strip 36 defines an aperture 82 between the intermediate and the horizontal strip portion 31, while a like aperture 84 is defined between the lower portion of the intermediate strip 36 and the reversely curved strip portion 32. The generally straight portions 66 and 72 of the intermediate strip, plus the semi-circular portion 70, and adjacent portions of the smaller radius semi-circular portions 64 and 76 define another aperture 86.

The 12 pack band or package unit carrier 26 initially is formed of a web of plastic material, preferably a thermoplastic resin such as polyethylene, in a continuous web with successive carriers integrally connected with one another along the fracture lines 58. Movement of the web and of the individual carriers is from left to right as shown in FIG. 2, whereby the intermediate strip 36 is in trailing relation and facilitates feeding of the web of carriers. Scrap material punched out to form the package unit 26 is recyclable.

At an assembly station the carriers 26 are separated from one another along the fracture lines 58, and the upper straight portion 32 and the lower reversely curved portion 32 are pulled away from one another, causing the intermediate strip to separate along the severance lines 68, 74 and 80 to stretch out into a straight strip as indicated at 36 in FIGS. 1 and 3 with the strip 28 encircling the outer perimeter of the adjacent pair of six packs. As previously noted, the intermediate strip 36 extends between the pair of six packs, whereby each and every can is contacted by a portion of the carrier, thus promoting stability of the resulting package. The package is readily carried by the handle 44 with the first two fingers of a hand inserted through one of the apertures 46, 48 and the remaining two fingers inserted through the other aperture. The carrier forms surface engagement with the cans.

The present invention is distinguished from the invention disclosed in the referenced related case in that the intermediate strip 36 comprises but a single strip or band, whereas in the referenced case the intermediate strip is initially two strips which pull together upon assembly with the pair of six packs. This facilitates assembly. Less material is required, and the structure generally is simplified.

The single example of the invention as herein shown and described is for illustrative purposes only. Various changes in structure will no doubt occur to those skilled in the art, it will be understood as forming a part of the present invention insofar as they fall within the spirit and scope of the appended claims.

The invention is claimed as follows:

1. A package unit comprising a plurality of cylindrical containers arranged in rows and columns, and a package unit carrier comprising a first resilient strip circumscribing all of said containers in surface contact with at least certain of said containers, and a single piece intermediate resilient strip integral with said first strip and extending between spaced portions thereof, said intermediate strip extending between predetermined adjacent containers in surface engagement therewith, each of said containers being engaged by at least one of said strip to provide a stable package.

2. A package unit as set forth in claim 1 and further including handle means on said first strip.

3. A package unit carrier comprising a first integral resilient plastic strip formed as a continous loop, handle means integral therewith, and a single piece intermediate strip extending across said loop and having opposite ends integral with said first strip.

4. A carrier as set forth in claim 3 wherein said loop lies substantially in a common plane, said intermediate strip also lying substantially in said common plane but being displaced from a straight line between said opposite ends to only one side of said straight line.

5. A carrier as set forth in claim 3 wherein said loop comprises a pair of arcuate ends interconnected on one side by a straight portion and on the other side by a portion of reverse curvature.

6. A carrier as set forth in claim 3 wherein said opposite ends are aligned and approach one another, then leading to a reverse curve back to an adjacent portion of said loop, and continuing as a further opposite curve and integrally joining one another.

7. A carrier as set forth in claim 6 wherein said ends extend into integral contact with one another and are joined by a readily severable section.

8. A carrier as set forth in claim 7 wherein said intermediate strip beyond said reversely curved portions closely approaches said loop on substantially opposite sides thereof and is integrally joined thereto by readily severable sections.

* * * * *